US005370787A

United States Patent [19]

Forbus, Jr.

[11] Patent Number: 5,370,787

[45] Date of Patent: Dec. 6, 1994

[54] THERMAL TREATMENT OF PETROLEUM RESIDUA WITH ALKYLAROMATIC OR PARAFFINIC CO-REACTANT

[75] Inventor: Thomas R. Forbus, Jr., Newtown, Pa.

[73] Assignee: Mobil Oil Corporation, Fairfax, Va.

[21] Appl. No.: 55,934

[22] Filed: Apr. 30, 1993

Related U.S. Application Data

[63] Continuation of Ser. No. 869,099, Apr. 14, 1992, abandoned, which is a continuation of Ser. No. 612,778, Nov. 13, 1990 abandoned, which is a continuation-in-part of Ser. No. 449,292, Dec. 5, 1989, now abandoned, which is a continuation of Ser. No. 223,824, Jul. 25, 1988, now abandoned.

[51] Int. Cl.[5] ..... C10G 9/00

[52] U.S. Cl. ..... 208/106; 208/107; 208/85; 208/125

[58] Field of Search ..... 208/106, 107, 125, 85

[56] References Cited

U.S. PATENT DOCUMENTS

| | | | |
|---|---|---|---|
| 2,756,186 | 7/1956 | Owen et al. | 196/49 |
| 2,756,186 | 7/1956 | Owen et al. | 196/49 |
| 3,310,484 | 3/1967 | Mason et al. | 208/125 |
| 3,310,484 | 3/1967 | Mason et al. | 208/125 |
| 3,549,519 | 12/1970 | Munro et al. | 208/125 |
| 3,817,853 | 6/1974 | Folkins | 208/50 |
| 4,178,228 | 12/1979 | Chang | 208/72 |
| 4,264,432 | 4/1981 | Gartside | 208/48 |
| 4,298,455 | 11/1981 | Huang | 208/48 |
| 4,455,219 | 6/1984 | Janssen et al. | 208/131 |
| 4,483,761 | 11/1984 | Paspek, Jr. | 208/106 |
| 4,518,487 | 5/1985 | Graf et al. | 208/131 |
| 4,604,185 | 8/1986 | McConaghy, Jr. et al. | 208/56 |
| 4,604,188 | 8/1986 | Yan et al. | 208/106 |
| 4,615,791 | 10/1986 | Choi et al. | 208/107 |
| 4,640,762 | 2/1987 | Woods et al. | 208/107 |
| 4,642,175 | 2/1987 | Rudnick | 208/88 |
| 4,661,241 | 4/1987 | Dabkowski et al. | 208/131 |
| 4,673,486 | 6/1987 | Orihashi et al. | 208/86 |
| 4,784,746 | 11/1988 | Farcasiu et al. | 208/106 |
| 4,944,863 | 7/1990 | Smith et al. | 208/106 |

FOREIGN PATENT DOCUMENTS 0087968 2/1983 European Pat. Off. .

OTHER PUBLICATIONS

"Modern Petroleum Technology", Edited by G. D. Hobson et al, pp. 279–283, 1975.

*Primary Examiner*—Paul Lieberman
*Assistant Examiner*—Patricia Hailey
*Attorney, Agent, or Firm*—Alexander J. McKillop; George W. Hager; Michael J. Mlotkowski

[57] ABSTRACT

Thermal treatment of heavy petroleum resid in the presence of moderate amounts of light aromatics or paraffins produces more liquid product at the expense of gas and coke than when treated alone under identical conditions.

15 Claims, No Drawings

THERMAL TREATMENT OF PETROLEUM RESIDUA WITH ALKYLAROMATIC OR PARAFFINIC CO-REACTANT

RELATED APPLICATIONS

This is a continuation of copending application Ser. No. 07/869,099, filed on Apr. 14, 1992, now abandoned, which is a continuation of copending application Ser. No. 07/612,778, filed on Nov. 13, 1990, now abandoned, which is a continuation-in-part of co-pending application Ser. No. 449,292, filed on Dec. 5, 1989, now abandoned, which is a continuation of application Ser. No. 223,824, filed on Jul. 25, 1988, now abandoned.

FIELD OF THE INVENTION

This invention relates to the thermal treatment of petroleum residua such as by cracking, visbreaking, or coking. More specifically it relates to the thermal treatment of residua in the presence of alkylaromatic or paraffinic co-reactants.

BACKGROUND OF THE INVENTION

In the following description of the invention the term "thermal treatment" is intended to include such processes as thermal cracking, visbreaking and coking, terms of art to those skilled in the art of petroleum refining.

The term "thermal cracking" is generally applied to the pyrolysis of distillates heavier than gasoline. Thermal cracking facilities now principally process cycle oils from catalytic cracking. As in other pyrolytic processes the feedstock is only partially converted in a single pass. The furnace effluent is quenched and the products are separated into gases and various fractions of liquid products.

When reduced crudes are pyrolyzed without substantial coke production, the process is called visbreaking. Because residual stocks have greater coking tendencies than gas oils, lower temperatures are employed in visbreaking than in thermal cracking. Typical reaction conditions are about 900° F. and 250 psi, and recycle is not usually employed.

Coking is similar in principle to visbreaking except that more severe conditions are used and the reduced crude is completely converted to lighter and heavier materials. Coking has the advantage over visbreaking in that it produces more distillates from a given charge. Coking temperatures may range from 930° F. to 1050° F.

SUMMARY OF THE INVENTION

In accordance with the present invention, there is provided a process for thermally cracking a virgin heavy hydrocarbon residuum wherein the residuum is heated at elevated temperatures and pressures to convert at least a portion thereof to lighter hydrocarbon liquids and gases the improvement comprising conducting the thermal cracking of the residuum at a temperature of between about 700° F. and about 900° F. and a pressure of between about 100 psig and about 1500 psig in the presence of a hydrocarbon aromatic, olefin or paraffin co-reactant, the co-reactant present in a ratio of between 5:1 and 1:3 parts by weight of residuum to co-reactant, wherein the co-reactant is effective to increase the portion of lighter hydrocarbon liquids while reducing coke and gas formation.

The present invention is predicated upon the discovery that the thermal treatment of heavy petroleum fractions is more selective to liquid products if done in the presence of moderate amounts of alkylaromatic or paraffinic co-reactants. The presence of these co-reactants substantially inhibits coke and gas production and increases liquid yields.

DETAILED DESCRIPTION OF THE INVENTION

In essence, this invention comprises the thermal treatment of a petroleum residuum in the presence of an alkylaromatic or paraffinic co-reactant. Preferably the alkylaromatic or paraffinic co-reactant is present in the form of a liquid carrier, although it is recognized that the co-reactant may by added to the petroleum residuum and the mixture then combined with some other liquid carrier. Preferred co-reactants are toluene and isobutane. Other suitable co-reactants include isobutylene, xylenes, benzene-toluene-xylene mixed streams, and gasoline.

Generally the residua is mixed with the co-reactant in a ratio of between 5:1 and 1:3 (parts by weight of residua to co-reactant). The thermal treating is carried out at mild coking conditions (700° F. to 900° F., and 100 to 1500 psig).

Utilizing this process, the yield of liquid produced is increased at the expense of gas and coke produced in comparison to the thermal treatment of residua alone. The rate of product formation is only slightly less with a co-solvent (co-reactant). Higher co-solvent concentrations, above 20 to 33 percent, give only slight increases of liquid products.

When normal alkylaromatics are thermally treated under conditions described hereinbelow, the liquid products produced are mainly paraffins and partially or completely dealkylated aromatics. Small amounts of olefins are also obtained. Highly condensed aromatics and coke are obtained in small quantities at long reaction times. When the alkylaromatics are thermally treated with an equivalent weight of toluene, alkylbenzenes are also obtained in addition to the products noted above. The source of alkylbenzenes is believed to be from free-radical type addition of olefin products to the methyl group of toluene. The addition of toluene to the system has been found to provide a means of controlling the thermal degradation of olefin products. In addition, toluene acts as a hydrogen atom donor which traps reactive radicals, thus inhibiting regressive reactions of these intermediates during the thermal process.

The thermal operations used in the refinery to process heavy ends of crudes, typically employ temperatures which cause homolysis of carbon-carbon single bond types, ultimately producing gases, lighter liquids and coke as products. Heavy petroleum resources which are known to be rich in alkylaromatic derivatives, when thermally treated with toluene, produce mainly paraffins and alkylbenzenes. Small amounts of olefins are also observed. As indicated, it has been discovered that such a co-treatment results in more liquid product and less gas and coke yield than when thermally treated alone under the same conditions to essentially the same conversion. Co-treatment with isobutane has a similar effect on these yields.

The present invention is further illustrated by the following non-limiting examples.

EXAMPLE I

Treatment of Model Compounds

This example relates to the treatment of model compounds and serves to illustrate the processes which occur during thermal processing.

Normal alkylaromatics were thermally treated in a closed system at 770° F. for times ranging from 0.5 to 3.0 hours. The synthesized alkylmononuclear and alkylpolynuclear aromatics employed included 4-n-decyl-1,2-dimethylbenzene (A), 2-n-decyl-naphthalene (B), n-decyldibenzothiophenes (C) and 1-n-decylpyrene (D). The pyrolysis of these model compounds and other compounds were done neat and as 1:1 (by weight) mixtures with toluene in preconditioned stainless steel tubes maintained at the reaction temperature in a preheated furnace. The liquid product mixtures were analyzed qualitatively by gas chromatography-mass spectroscopy (GC-MS) and quantitatively by FID (flame ionization detector) gas chromatography using a 12 ft. column for separation. Decomposition rates were measured competitively as equal weight mixtures of compounds undiluted and in an equivalent weight of toluene. No corrections for gaseous products were done. Liquid reaction products from the various model compound decomposition were determined from independent runs in equivalent weights of toluene.

The thermal decomposition of n-alkylaromatics in a closed system was found to ultimately lead to aromatics which are unsubstituted and substituted aromatics bearing smaller alkyl groups, mainly methyl and ethyl. Paraffins which are equivalent to or smaller than the original alkyl group of the alkylaromatic were obtained in good yields. Olefins and more highly condensed aromatics were obtained in smaller quantities. Small amounts of coke were obtained when the reactants were treated to high conversion.

Relative rates of decomposition, both in the presence and absence of an equivalent weight of toluene, are shown in Table 1, below.

TABLE 1

Relative Rates of Decomposition of n-Alkylaromatics

| | | Without Toluene | With Toluene |
|---|---|---|---|
| A | 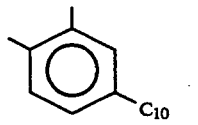 | 1.00 | 1.00 |

TABLE 1-continued

Relative Rates of Decomposition of n-Alkylaromatics

| | | Without Toluene | With Toluene |
|---|---|---|---|
| B | 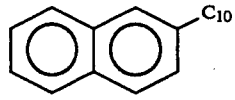 | 2.87 | 1.22 |
| C | 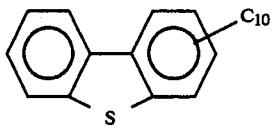 | 2.46 | 1.15 |
| D | 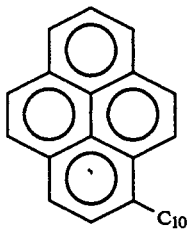 | 5.06 | 1.61 |

It is believed that there are three main modes of thermal decomposition which alkylaromatics undergo under these conditions. These are $\alpha$, $\beta$, and $\gamma$-scission. The modes of bond cleavage and cage product formation in alkylaromatic thermal decomposition reactions are shown below for alkylnaphthalene:

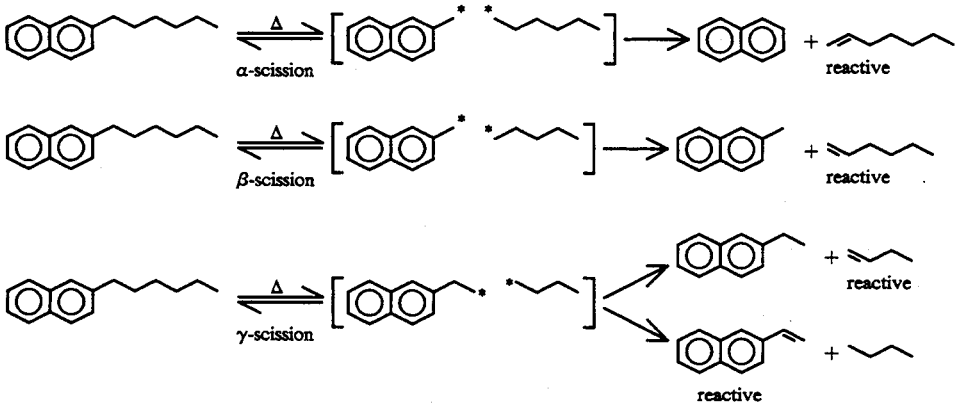

The relative rates of these three processes were found to be dependent upon the aromatic moiety, as shown in Table 2, below.

TABLE 2

Relative Rates of Three Primary Scission Processes

| | | α | β | γ |
|---|---|---|---|---|
| A | 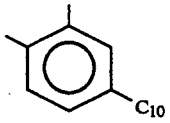 | 0 | 3.45 | 1.00 |
| B | 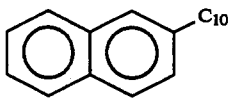 | 0.15 | 2.39 | 1.00 |

TABLE 2-continued

| Relative Rates of Three Primary Scission Processes | | α | β | γ |
|---|---|---|---|---|
| C | 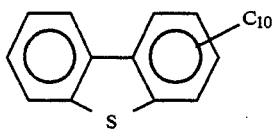 | 0 | 2.57 | 1.00 |
| D | 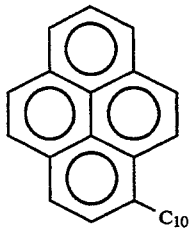 | 3.47 | 1.76 | 1.00 |

While these were not truly precise measurements, since γ-scission can also produce styrenic-type products by reaction within a solvent cage, whereas α- and β-scission cannot, styrenic-type products were not observed in the reaction products. It is believed that the styrenic-type products are extremely reactive under these conditions and it is further thought that they may be the precursors to the small amounts of more highly condensed aromatics and coke formed in these reactions.

The relative rates of these primary decomposition pathways can not be correlated with the relative rates of formation of the paraffinic and olefinic products. Two explanations are possible for this observation. One is that the initially formed alkyl radicals can undergo a variety of regressive reactions to lighter products if they are not immediately capped with hydrogen in the caged-radical pair reactions. The second is that the olefinic products are reactive under the reaction conditions. Olefins can undergo regressive decomposition to form light paraffins and olefins. This was confirmed by independent experiment under identical conditions with 1-nonene in toluene.

These detrimental reactions which cause formation of lighter products and which adversely effect overall yield and product slate can be controlled if a thermally stable material is present during the reaction which can: (1) competitively cap with hydrogen the reactive radicals which escape from reaction in the solvent cage to form even-electron products; and, (2) competitively trap olefins to inhibit their breakdown to lighter paraffins and olefins. A group of materials which satisfy the first requirement is the class of hydroaromatic compounds, such as tetralin and dihydropyrene. A group of materials which satisfy both of these requirements to some degree is the class of methylbenzenes.

The thermal decomposition of the n-decylaromatics A, B, C and D in the presence of toluene produces alkylbenzene which bear normal alkyl chains ranging from $C_2$ to $C_{11}$ in addition to the products mentioned above. Depending upon the aromatic moiety, alkylbenzenes are formed in varying amounts (see Table 3). The formation of these alkylbenzenes is believed to occur from free radical-type addition of the α-olefinic products to the benzylic methyl group of toluene. Supportive evidence is the formation of alkylbenzenes from independent thermal treatment of 1-nonene with toluene under identical conditions. In all cases the major alkylbenzene product from thermal decomposition of n-decylaromatics in the presence of toluene was found to be n-decylbenzene. This corresponds to the addition of 1-nonene (cage product from β-scission of n-decylaromatics) to toluene. Alkylbenzenes with shorter alkyl chains are believed to arise from addition of smaller olefinic products to toluene. The source of smaller olefins is from concurrent thermal decomposition of initially formed olefins to lighter olefins and paraffins.

The presence of toluene has other effects upon the reaction course during thermal decomposition of n-alkylaromatics. One of these is higher selectivity to longer chain paraffins which is manifested by greater amounts of paraffin products derived from the three primary cleavage mechanisms. For an n-decylaromatic these are decane, nonane and octane corresponding to α, β and γ-cleavage, respectively. As shown in Table 3, below, for the thermal reactions of mixtures of A, B, C and D (equivalent weights) in the presence and absence of an equivalent weight of toluene, the selectivity of the alkyl radicals to these primary products was found to be considerably higher when toluene is present. This is manifested by the higher $(C_8+C_9+C_{10})/C_n$ paraffin ratio. This phenomenon is thought to arise from hydrogen capping of the cage-escaped alkyl radical (derived from the primary scission reactions) competitively with breakdown of these radicals and/or other regressive reactions which produce lighter products from these alkyl radicals. The presence of toluene functioning in this way has the added positive effect of producing greater amounts of product from the alkyl group of the alkylaromatic based upon the actual amount of alkylaromatic decomposed (see Table 3). This is shown as a percentage of the theoretical amount of alkyl groups appearing as paraffin and olefin and as alkyl portion of the alkylbenzenes in the products.

TABLE 3

| Product and Yield Selectivities for Model Compounds (1/1: compound/toluene, 770° F., 1 hr.) | % Yield (1) | % Selectivity (2) to primary products | % Selectivity to Alkylbenzenes (3) |
|---|---|---|---|
| 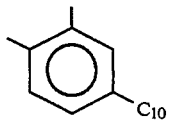 | 65 | 70 | 24 |
| 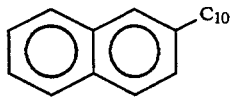 | 72 | 58 | 13 |
| 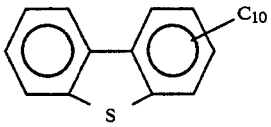 | 68 | 65 | 22 |

TABLE 3-continued

Product and Yield Selectivities for Model Compounds (1/1: compound/toluene, 770° F., 1 hr.)

| | % Yield (1) | % Selectivity (2) to primary products | % Selectivity to Alkylbenzenes (3) |
|---|---|---|---|
| 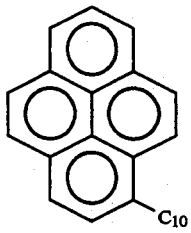 | 80 | 72 | 8 |
| Mixture 1* | 88 | 75 | 19 |
| Mixture 2** | 79 | 60 | — |

Yield of alkyl group in product relative to theoretical amount expected based upon actual amount of decomposed alkylaromatic:

$$\frac{\text{Actual alkyl product}}{\text{theoretical alkyl product}}$$

(2) Selectivity to primary products (paraffinic):

$$\sum_{n=1}^{n} \frac{C_8 + C_9 + C_{10}}{C_n}$$

(3) Selectivity of alkyl group to form alkylbenzenes:

$$\frac{\text{amt. (alkylbenzenes)}}{\text{amts. (paraffins + alkylbenzenes)}}$$

*1:1:1:1 wt ratio of A, B, C and D in equivalent wt of toluene.

**1:1:1:1 wt ratio of A, B, C and D.

EXAMPLE II

Treatment of Resid with Light Aromatic Material

A portion of a virgin Arab Light vacuum resid (end point 1075+° F.) was tested in undiluted form and in admixture with toluene. One portion was placed in undiluted form in a stirred autoclave and heated at 800° F. under an initial pressure of hydrogen of 100 psi for one hour. Two additional portions were mixed with toluene in a ratio of 1:2 and 3:2 parts by weight of resid to toluene respectively. These were also heated in a stirred reactor under 100 psig pressure of hydrogen and a temperature of 800° F. Each sample was then allowed to cool and the gas pressure was then released from the system. The material remaining was filtered and the solid residue washed with dichloromethane. The remaining dried solid was considered to be coke. Degree of conversion was determined by chromasorb-/simulated distillation of the liquid products. The mass unaccounted for was considered to be the mass of the gaseous products. Conversion and product distributions are shown in Table 4.

EXAMPLE III

Treatment of Resid with Light Paraffinic Material

In tests similar to those of Example I the portions of the same Arab light vacuum resid were mixed with isobutane in a weight ratio of 5:1 parts by weight of resid to isobutane. The reaction was conducted in a stirred autoclave at 800° F. under autogenous pressure. After cooling the gases were bled from the system and the remaining material was filtered and treated as described above. Conversion and product distribution are also shown in Table 4.

TABLE 4

Product Distribution of Resid Thermal Treatments With and Without Added Light Aromatic or Paraffin (800° F., 1 hour)

| | Resid Undiluted | Wt. Ratio Resid to i-$C_4$ (5:1) | Wt. Ratio Resid to Toluene (3:1) | Wt. Ratio Resid to Toluene (1:2) |
|---|---|---|---|---|
| $C_4^-$ | 15.0 | 8.1 | 8.2 | 8.4 |
| $C_5$-900° F. | 47.6 | 51.9 | 48.4 | 54.7 |
| Coke | 8.1 | 6.8 | 5.0 | 4.4 |
| Conversion | 70.7 | 66.8 | 61.6 | 67.5 |

The results of thermal treatment of Arab light vacuum resid with toluene show an increase in liquid yield at the expense of coke and gas yields at similar reside conversion levels. The fact should be noted that increasing the toluene content of the mixture by a factor of 6 has essentially no effect on gas make and little effect on coke yields.

From gas chromatography-mass spectroscopy analyses the major products formed were determined to be normal paraffins with smaller amounts of iso-paraffins and olefins in the resid treated alone. In the presence of toluene, alkylbenzenes were also observed in the product mixture.

The results of thermal treatment of Arab light vacuum resid in a 5:1 mixture (by weight) with isobutane show a net increase in liquid products at the expense of coke and gas formation (Table 4) at similar resid conversion under similar reaction conditions relative to resid treated alone. The major products again are normal paraffins. Minor products consist of branched alkanes. No evidence for significant isobutane incorporation into the products could be obtained either by nuclear magnetic resonance or gas chromatography-mass spectroscopy.

The mechanism by which isobutane can reduce the gas and coke yields from thermal treatment of residua is believed to be its hydrogen donor ability. The majority of alkyl radicals formed from the resid decomposition are primary. Abstraction of the tertiary hydrogen of isobutane by these primary radicals yields a tert-butyl radical and an alkane. Such an exothermic process can prevent regressive reactions of the alkyl radicals produced from the resid decomposition in favor of stabilized tert-butyl radicals which are relatively unreactive.

Although the present invention has been described with preferred embodiments, it is to be understood that modifications and variations may be resorted to without departing from the spirit and scope of this invention, as those skilled in the art will readily understand. Such modifications and variations are considered to be within the purview and scope of the appended claims.

What is claimed is:

1. In a process for thermally cracking a virgin heavy hydrocarbon residuum wherein said residuum is heated at elevated temperatures and pressures to convert at least a portion thereof to lighter hydrocarbon liquids and gases the improvement comprising conducting said thermal cracking of said residuum at a temperature of between about 700° F. and about 900° F. and a pressure of between about 100 psig and about 1500 psig in the presence of a hydrocarbon aromatic, olefin or paraffin hydrogen atom donor co-reactant, said hydrogen atom donor co-reactant present in a ratio of between 5:1 and 1:3 parts by weight of residuum to co-reactant, wherein said hydrogen atom donor co-reactant reacts with said residuum to cap with hydrogen reactive radicals formed during the thermal cracking process and increase said portion of lighter hydrocarbon liquids while reducing coke to an amount of about 6.8% or less by weight and gas formation.

2. The process of claim 1 wherein said heavy hydrocarbon residuum has an API gravity of about 10 to about 35 degrees API.

3. The process of claim 1 wherein said light aromatic hydrocarbon is selected from the group consisting of toluene, xylenes, benzene, gasoline and mixtures thereof.

4. The process of claim 1 wherein said paraffin is isobutane.

5. The process of claim 1 wherein said thermal cracking process is a visbreaking process.

6. The process of claim 1 wherein said thermal cracking process is a coking process.

7. The process of claim 1 wherein said olefin is isobutene.

8. The process of claim 1 wherein said co-reactant is present in an amount below 33 percent relative to said residuum.

9. The process of claim 8 wherein said co-reactant is present in an amount below 20 percent relative to said residuum.

10. In a process for thermally cracking a virgin heavy hydrocarbon residuum wherein said residuum is heated at elevated temperatures and pressures to convert at least a portion thereof to lighter hydrocarbon liquids and gases the improvement comprising conducting said thermal cracking of said residuum at a temperature of between about 700° F. and about 900° F. and a pressure of between about 100 psig and about 1500 psig in the presence of a hydrocarbon hydrogen atom donor co-reactant selected from the group consisting of toluene, xylenes, benzene, gasoline, isobutane, isobutene, and mixtures thereof in a ratio by weight of said hydrocarbon co-reactant to said heavy hydrocarbon residuum of between 5:1 and 1:3 respectively, wherein said hydrogen atom donor co-reactant reacts with said residuum to cap with hydrogen reactive radicals formed during the thermal cracking process and increase said portion of lighter hydrocarbon liquids while reducing coke to an amount of about 6.8% or less by weight and gas formation.

11. The process of claim 10 wherein said heavy hydrocarbon residuum has an API gravity of about 10 to about 35 degrees API.

12. The process of claim 10 wherein said thermal cracking process is a visbreaking process.

13. The process of claim 10 wherein said thermal cracking process is a coking process.

14. The process of claim 10 wherein said co-reactant is present in an amount below 33 percent relative to said residuum.

15. The process of claim 14 wherein said co-reactant is present in an amount below 20 percent relative to said residuum.

* * * * *